US005280653A

United States Patent [19]

Tsai

[11] Patent Number: 5,280,653

[45] Date of Patent: * Jan. 25, 1994

[54] TOILET-SEAT FLUSH-VALVE OPERATING DEVICE

[76] Inventor: Wei-Chang Tsai, Room 5, 2F, No. 80, Ho Ping West Road, Sec. 1, Taipei, Taiwan

[ * ] Notice: The portion of the term of this patent subsequent to Jan. 12, 2010 has been disclaimed.

[21] Appl. No.: 956,258

[22] Filed: Oct. 5, 1992

Related U.S. Application Data

[63] Continuation-in-part of Ser. No. 685,892, Apr. 16, 1991, Pat. No. 5,177,818.

[51] Int. Cl.[5] ..... E03D 5/04; A47K 13/10

[52] U.S. Cl. ..... 4/246.2; 4/250

[58] Field of Search ..... 4/241, 246.1, 246.2, 4/248, 249, 250

[56] References Cited

U.S. PATENT DOCUMENTS

| | | | |
|---|---|---|---|
| 481,498 | 8/1892 | Kremelberg | 4/250 |
| 1,277,275 | 8/1918 | Vogel | 4/249 X |
| 1,605,939 | 11/1926 | Haas | 4/250 |
| 1,821,027 | 9/1931 | Oya | 4/246.2 |
| 4,291,422 | 9/1981 | Shoemaker et al. | 4/246.2 |
| 4,338,690 | 7/1982 | Hsieh et al. | 4/250 X |
| 4,551,866 | 11/1985 | Hibbs | 4/246.1 |
| 5,020,165 | 6/1991 | Huang | 4/246.2 |
| 5,177,818 | 1/1993 | Tsai | 4/241 |

FOREIGN PATENT DOCUMENTS

| | | | |
|---|---|---|---|
| 214186 | 10/1909 | Fed. Rep. of Germany | 4/246.2 |
| 271013 | 5/1928 | Italy | 4/249 |
| 90/06715 | 6/1990 | PCT Int'l Appl. | 4/246.2 |
| 256619 | 7/1927 | United Kingdom | 4/249 |

*Primary Examiner*—Robert M. Fetsuga

*Attorney, Agent, or Firm*—Wenderoth, Lind & Ponack

[57] ABSTRACT

A toilet-seat flush-valve operating device has an energy transceiver, a connecting portion and a control portion. When adapted to conventional toilet equipment, the device serves to raise and lower the toilet seat automatically. If necessary, a flush-valve opening arrangement is mounted between the energy transceiver and the flush valve so that the device also operates to automatically open the flush valve at the appropriate time. The toilet seat stays at a slightly forwardly inclined vertical position and always tends to fall under its own weight. When an outside force is applied to the control portion, which is capable of transmitting the outside force to the energy transceiver, comprised of a spring and/or a dead weight, the energy transceiver is driven and releases the toilet seat from the control of a linkage mechanism, thereby permitting the seat to fall under its own weight. When the toilet seat falls to lay flat on the toilet bowl and has completed its stoke, it is then possible to withdraw the outside force. Thereafter, the energy transceiver starts to act in a direction opposite to the stroke mentioned above to release the energy gathered from the toilet seat during the stroke. The energy is returned to the toilet seat through the connecting portion as dynamic energy for raising the toilet seat.

10 Claims, 4 Drawing Sheets

TOILET-SEAT FLUSH-VALVE OPERATING DEVICE

This application in part discloses and claims subject matter disclosed in my earlier filed pending application, Ser. No. 07/685,892, Filed 1991 Apr. 16, now U.S. Pat. No. 5,177,818, issued Jan. 12, 1993.

BACKGROUND OF THE INVENTION

The present invention relates to a toilet-seat flush-valve operating device having an energy transceiver, a connecting means and a control means.

In the applicant's first patent (noted above), a toilet-seat flush-valve operating device is disclosed in which raising and lowering of the toilet seat is performed by vertical movements of a piston means having the function of a dead weight. In view of the fact that a spring can replace the dead weight to perform the same function, that, in particular, when the original cylinder unit is to be mounted transversely there must be used a spring, and that since the use of a spring helps reduce the volume, in the present device, therefore, the dead weight acting also as the piston means in the previous application is substituted with a spring acting as an energy transceiver, particularly when an actuating fluid of high pressure is used. In other words, the original piston-cum-static-weight, after modification, forms a hydraulic pressure-plate-plus-spring of the present invention.

A clearance is formed between a control drum and a pressure plate slidable in the control drum. This clearance is capable of getting rid of any friction formed between the original piston means and the cylinder enabling the device of the invention to be almost devoid of any friction loss, so that with the help of a very small outside force it is possible to raise or lower the toilet seat. As mentioned above, owing to the location of the clearance between the control drum and the pressure plate, there is no formation of any friction, and the two need no grinding of their relative surfaces. This represents not only a saving of work, it is also possible to make the control drum polygonal, and there is even convenience in the selection of materials. Furthermore, the clearance serves as substitute for the bypass port in the original piston, and acts as an outlet passage for the actuating fluid, thereby making it possible for the omission of the bypass valve and piston ring. Along with the simplification in construction, it also makes possible the elimination of troubles such as replacement of an old piston ring with a new piston ring. Again, because of this clearance, there is not only a difference in construction from the conventional cylinder unit, the function is also different in that the pressure plate is not to drive the toilet seat, and by limiting the clearance it is also possible to control the speed of descent of the pressure plate.

SUMMARY OF THE INVENTION

In order to achieve the foregoing purposes, the present invention has for its object to provide a toilet-seat flush-valve operating device comprising an energy transceiver, a connecting means and a control means. The control mans has a control drum, a hydraulic pressure plate driven to work in the control drum through a clearance by an actuating fluid, a control valve in charge of the provision of the actuating fluid and connecting pipes connecting, respectively, the inlet of the control valve and the supply pipe of the fluid source and the outlet of the control valve and the inlet of the control drum. The energy transceiver has a spring, with the pressure plate acting as its seat in the control drum. The pressure plate possesses more or less a static weight function, hence the energy transceiver is, in a strict sense, formed by mutual cooperation of a spring and a dead weight, and since the pressure plate also serves as the spring seat and the energy transceiver, this pressure plate is thus of a triple use. The energy transceiver accumulates and stores therein the potential energy released by the toilet seat during the descent of the latter by its own weight and the energy supplied by the working fluid when the control valve is opened to provide the operating fluid. Next, when the toilet seat lays flat on the bowl and cuts off the operating fluid, this energy transceiver releases the energy accumulated therein during the last stroke for use as a dynamic force to raise the toilet seat.

BRIEF DESCRIPTION OF THE DRAWINGS

Other objects and features of the present invention will be clear from the accompanying drawings, in which.

DESCRIPTION OF A PREFERRED EMBODIMENT

In the following, although a control drum 54 can be transversely mounted, description will be based on an embodiment where the control drum 54 is vertically mounted and easily available house water supply is used as an actuating fluid.

Figure 1:
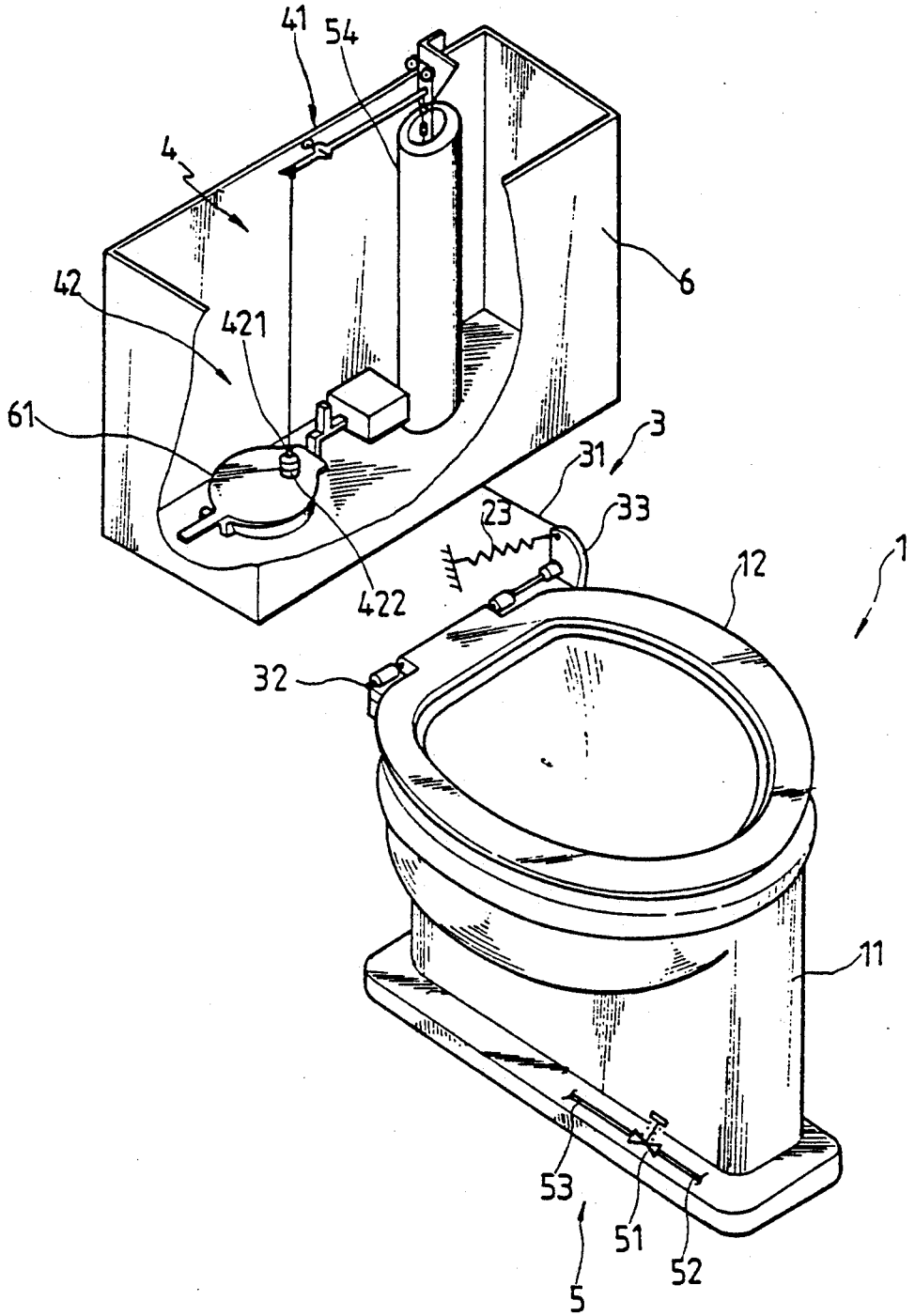
FIG. 1 is a perspective view in partial section of an embodiment of a water closet fitted with a toilet-seat flush-valve operating device in accordance with the invention.
Figure 2:
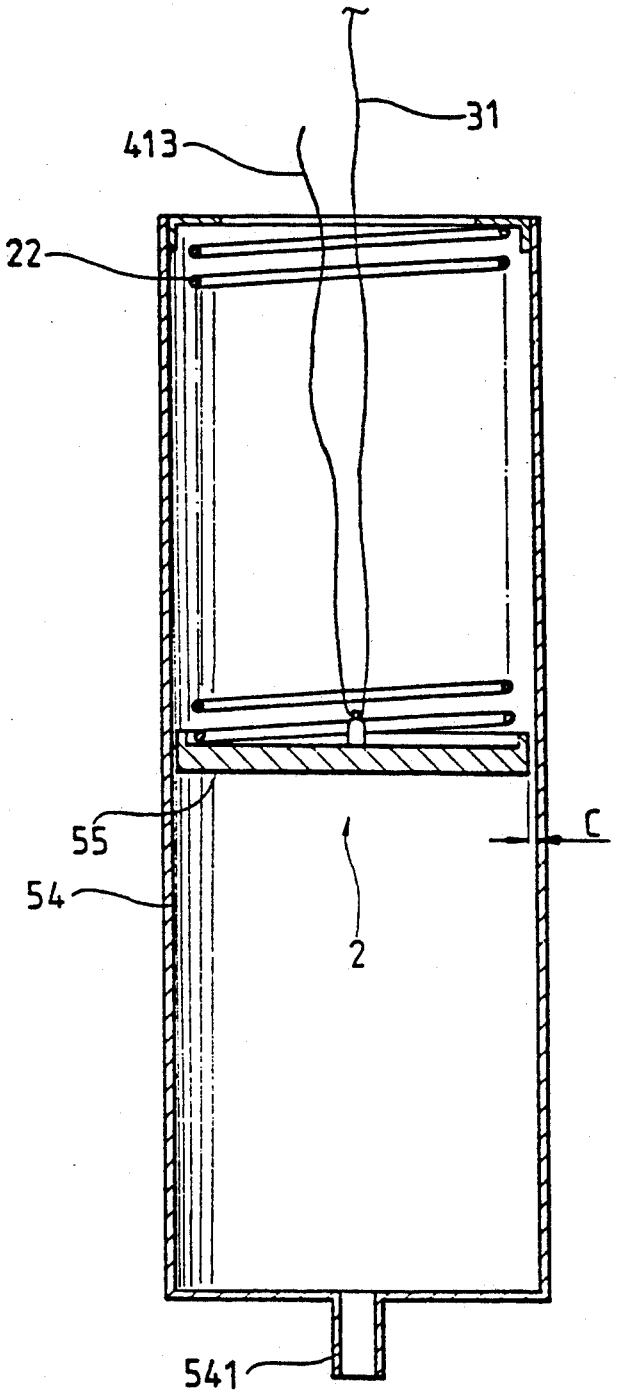
FIG. 2 is an enlarged longitudinal sectional view of a control drum and an energy transceiver.
Figure 3:
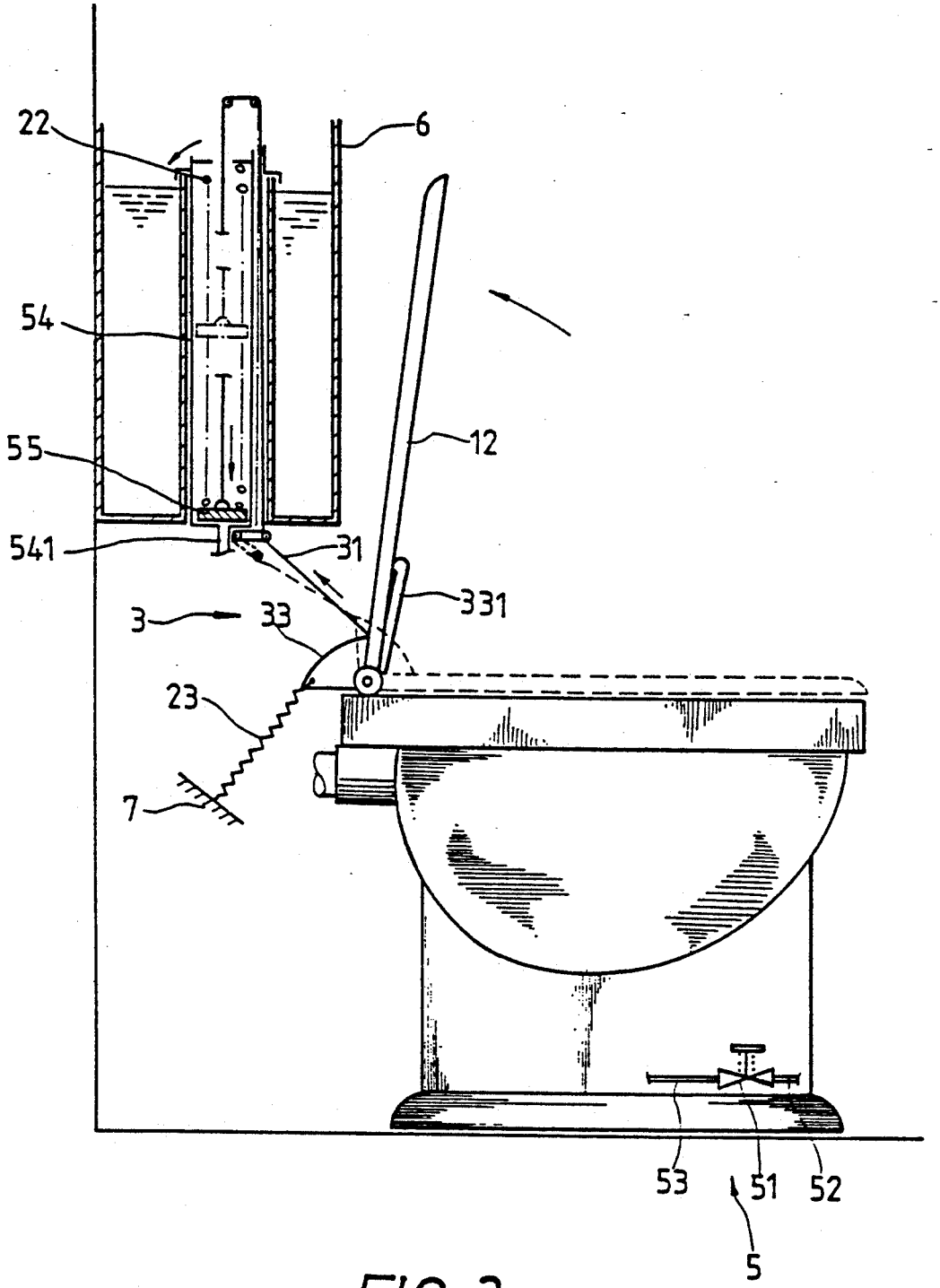
FIG. 3 is a side view of the water closet of FIG. 1, in partial longitudinal section, showing the toilet seat in the raised position.

As shown in FIGS. 1 and 3, the toilet-seat flush-valve operating device of the invention comprises an energy transceiver 2, a connecting means 3 and a control means 5. The control means 5 includes a control drum 54, a hydraulic pressure plate 55, a control valve 51, a supply pipe 52 and a connecting pipe 53. The control valve 51 is a conventional unidirectional valve which opens upon being stepped on by a foot and closes automatically when the foot is removed. The supply pipe 52 connects the inlet of the control valve 51 to the water supply source, and the connecting pipe 53 connects the outlet of the control valve 51 to an inlet 541 of the control drum 54. The energy transceiver 2 is, as shown in FIG. 2, formed by mounting a spring 22 inside the control drum 54 with the pressure plate 55 serving as its seat, and the pressure plate 55 having a clearance c. When driven by the actuating fluid, the pressure plate 55 compresses the spring 22, enabling the spring 22 to accumulate and store the energy of the actuating fluid inside its body.

The clearance c located between the pressure plate 55 and the inner wall of the control drum 54 serves to remove any friction between the two, and is also used as an outlet passage for the actuating fluid, such that by limiting the clearance c it is possible to control the speed of falling of the pressure plate 55. The connecting means 3 comprises an operating disk 33 possessing a support arm 331 supporting the toilet seat 12 from thereunder and a connecting cord 31 connecting the pressure plate 55 and the operating disk 33. Both the operating disk 33 and the toilet seat 12 are pivotably mounted on a pivot shaft 32. It is to be noted that the connecting means 3 is not limited to the above construction, and there are other conventional methods as for example disclosed in the parent patent. In the device of the present invention, although the toilet seat 12, which stays at a slightly forwardly inclined vertical position, always as to fall under its own weight, it is nevertheless under the control of the energy transceiver 2, and will stay in position. Therefore, when a user steps on the control valve 51 to open the valve, water passes through supply pipe 52, control valve 51 and connecting pipe 53, and next through the inlet 541 of the control drum 54, to flow into the drum. Inside the drum the water drives the pressure plate 55, compresses the spring 22 and provides the spring with the energy from the actuating fluid. At the same time, this water also releases the connecting means 3 from control of the toilet seat 12. The support arm 331 now no longer supports the toilet seat 12. The toilet seat 12 is thus able to fall under its own weight while, in the opposite direction, pulling up the pressure plate 55 by means of the connecting means 3 thereby further compressing the spring 22 and providing the spring the stored energy thereof until the toilet seat 12 lays flat on the bowl 11. Speaking in another way, because the descent of the toilet seat 12 is still under the control of the spring 22, no sound is produced when the toilet seat 12 covers flat on the bowl 11. At this time, although the toilet seat 12 no longer falls, the user must continue to step on the control valve 51 to enable the pressure plate 55 to ascend over a lost motion stroke. Following the ascent of the pressure plate 55, when the connecting cord 31 has become loose, the user then releases the control valve 51 and cuts off the actuating fluid. Immediately, the spring 22 releases the energy that has been absorbed during the above stroke to push the pressure plate 55 in an opposite direction. Before the pressure plate 55 has returned to the starting point of the lost motion stroke, the connecting cord 31 is still in the loose condition and unable to lift the toilet seat 12 up. Furthermore, because the accumulated water, which is to be discharged from beneath the pressure plate 55 onto its upper portion through the clearance c, is under restriction from the clearance c acting as the outlet passage, the speed of descent of the pressure plate 55 is slow. Hence, there is a sufficient time lag to allow the user to conveniently use the toilet seat 12 from when the user moves his foot from the control valve 51 to when the toilet seat 12 starts to ascend. The pressure plate 55 continues to be pushed downwardly by the spring 22, and eventually returns to the starting point of the lost motion stroke to tighten the connecting cord 31. The pressure plate 55 stops falling at this point, as the user has sat on the toilet seat 12. Next, when the user finishes and stands up, the spring 22, as shown in FIG. 3, releases the energy absorbed during the last stroke and pushes the pressure plate 55 down. The falling pressure plate 55, by means of the connecting cord 31, rotates the operating disk 33 in the opposite direction and through the support arm 331 integrally formed therewith pushes up the toilet seat 12, and in this way returns the energy collected from the toilet seat 12 during the last stroke to the toilet seat 12. In the present embodiment, although it is not compulsory, a counterbalancing spring 23 is nevertheless provided between the operating disk 33 and a fixing frame 7. When the toilet seat 12 lays flat on the bowl 11, the torque required to raise the toilet seat to ascend is large. During this time, the counterbalancing spring 23 is in the extended state and the tension force is large. Following the ascent of the toilet seat 12, the torque needed in pulling it upwardly becomes gradually reduced, while the counterbalancing spring 23 gradually becomes shortened, and thus reduces its tension force. After the pressure plate 55 driven by the spring 22 has reached the bottom end of the control drum 54 and stops there, the toilet seat 12 also arrives at the slightly forwardly inclined vertical position and returns to its original position.

Figure 4:
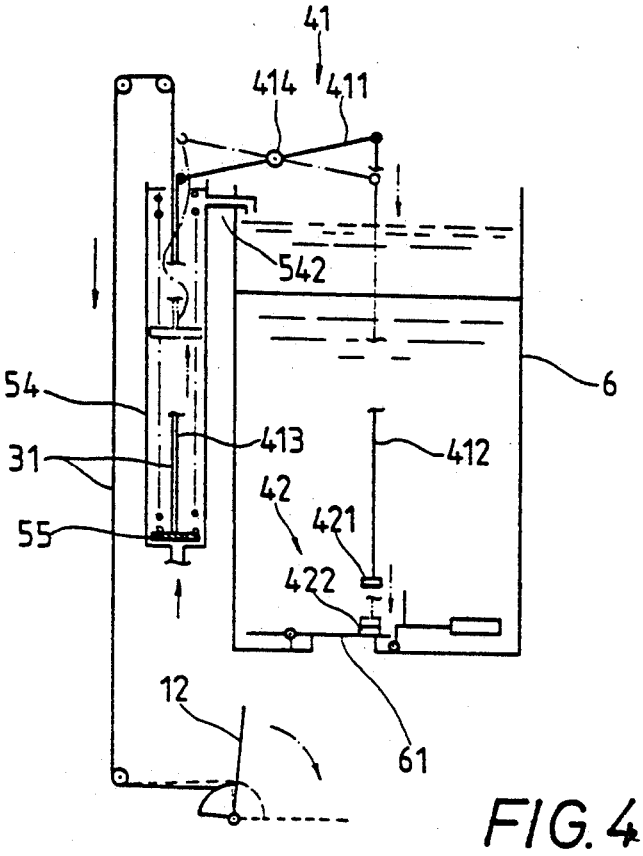
FIGS. 4 and 5 are schematic side views showing one embodiment of the control drum in the actuation of the flush-valve opening system of the device.
Figure 5:
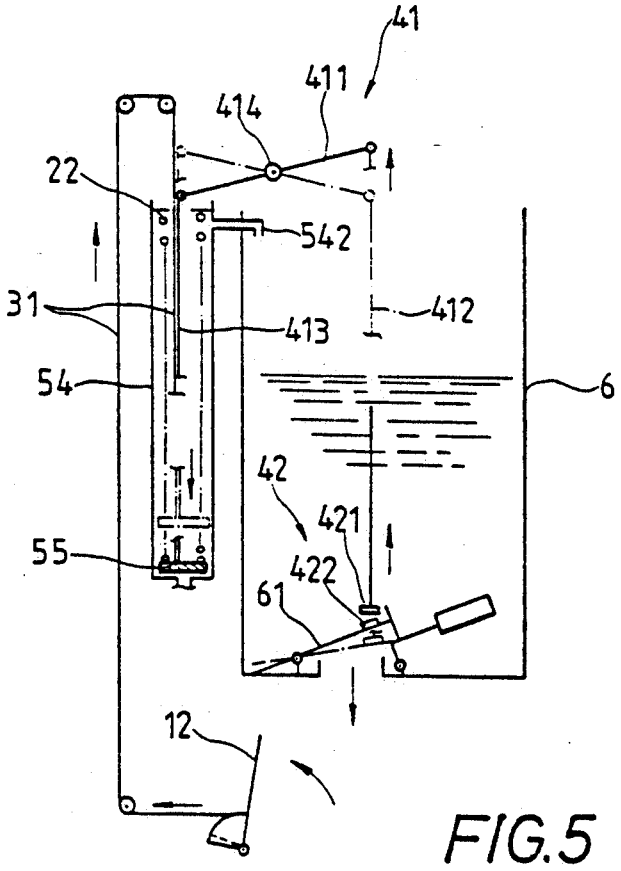

Because it is also possible to utilize the above control means 5 and the energy transceiver 2 to automatically open a flush-valve 61, a flush-valve opening means 4 may therefore be located between the energy transceiver 2 and the flush valve 61. As shown in solid lines in FIG. 4, when the toilet seat 12 is in the vertical position, a magnet 421 and a magnet 422 are separate from each other, and the flush valve 61 is closed. A cistern 6 is filled with water by a conventional feed valve (not shown) until a water level as shown with a solid line is reached. As described above, when the control valve 51 is stepped on to provide the actuating fluid and drive the pressure plate 55 to ascend, thereby permitting the toilet seat 12 to descend, the magnet 421 by its own weight also falls down and is attracted to the magnet 422 to form a single body. Thereafter, following the ascent of the pressure plate 55, a link body 413 becomes gradually loosened, water that has accumulated on the upper surface of the pressure plate 55 and water that has escaped from the clearance c onto the upper surface of the pressure plate 55 along with the ascent of the pressure plate 55 are discharged into the cistern 6 through an outlet 542. As a result, the level of water inside the cistern 6 increases to the water level as shown with a dotted line in FIG. 4. Next, when the user finishes and stands up, the pressure plate 55 starts to descend, whereby it raises up the toilet seat 12. Until the pressure plate 55 almost reaches the bottom end of the control drum 54, it is then possible to tighten the formerly loosened link body 413. Following this action, the magnet 421 and magnet 422 that have been attracted to each other to form a single body are pulled up together with the flush valve 61 by means of a transverse rod 411 and a suspending rod 412, and the flush valve 61 becomes open. Consequently, the flush valve 61 starts to flush the toilet bowl 11. The falling speed of the pressure plate 55, as described before, is under the control of the clearance acting as the outlet passage of the working fluid, and slow. Hence, when the user finishes the use, stands up and starts to flush, there is a sufficient time lag for the user's convenience. When the flush valve 61 is pulled up to a predetermined level of opening, the valve will open no more. The magnet 421 which is still being pulled up by the pressure plate 55 that is still descending now becomes separate from the magnet 422 fixed to the flush valve 61. Then, as shown in solid line in FIG. 5, as the pressure plate 55 has arrived at the bottom end of the control drum 54, the magnet 421 also stops and no longer ascends. As to the closing of the flush valve 61 and the re-filling of water in the cistern 6, these are known techniques and will therefore not be dealt with in detail here.

In the above, the condition of use has been described when there is need for a bowel movement. When use is for urinating, it is only needed to step on the control valve 51 for a while after urinating, and the toilet seat 12, as seen from the outside, is in an almost unmoved condition. In other words, the pressure plate 55 ascends just a little, and the magnet 421 immediately is attracted to the magnet 422 to become a single body. Following this action, the user may now let off the control valve 51, and within a second, the flush valve 61 is pulled open to flush. As described above, since this pressure plate 55 stays almost motionless, there will be no increase in the water level inside the cistern 6. Hence, in this way the device of the present invention accomplishes the purpose of saving water during urination.

I claim:

1. A toilet-seat operating device in a water closet having a toilet bowl, a cistern, a toilet seat pivotably mounted on said toilet bowl for pivotal movement about a horizontal axis between a generally vertical position and a generally horizontal position and a flush valve for flushing fluid from the cistern to the toilet bowl, said toilet-seat operating device comprising:

a control drum;

a fluid pipeline connecting a pressurized working fluid supply and said control drum and a control valve in said fluid pipeline for controlling the supply and cutoff of working fluid to said control drum;

an energy accumulating and releasing device comprising a spring and a pressure plate positioned inside said control drum, said plate operably connected with said spring and connecting means joining the toilet seat and said energy accumulating and releasing device providing for said energy accumulating and releasing device to accumulate energy from the toilet seat falling under its own weight and to release energy to raise the toilet seat, and said energy accumulating and releasing device also accumulating energy from said working fluid when supplied to said control drum;

wherein opening of said control valve causes working fluid to be supplied to said control drum to move said pressure plate, lowering said toilet seat under its own weight and causing energy from the lowering of said toilet seat and the working fluid to be stored, and closing of said control valve causes working fluid to be cut off from said control drum and said energy accumulating and releasing device to release the stored energy so that the toilet seat is raised.

2. The toilet-seat operating device of claim 1, wherein energy is stored by movement of said pressure plate in one direction in said control drum and released by movement of said pressure plate in the other direction.

3. The toilet-seat operating device of claim 1, wherein said control drum has opposite ends, with one said end having said fluid pipeline connected thereto for the supply of working fluid and wherein the other end has a working fluid exit.

4. The toilet-seat operating device of claim 1, wherein said connecting means comprises a connecting lever unit engaged with the toilet seat and a link body having one end joined to said connecting lever unit and the other end to said energy accumulating and releasing device.

5. The toilet-seat operating device of claim 4, wherein said connecting level unit has a counterbalancing spring connected thereto for counterbalancing the toilet seat.

6. The toilet-seat operating device of claim 1, wherein a flush-valve opening means is provided for opening the flush valve to flush fluid from the cistern to the toilet bowl in response to a release of energy by said energy accumulating and releasing device, said flush valve opening means comprising an engaging element engageably mounted on the flush valve and a connector having one end joined to said energy accumulating and releasing device and the other end joined to said engaging element.

7. The toilet-seat operating device in a water closet having a toilet bowl, a cistern, a toilet seat pivotably mounted on said toilet bowl for pivotal movement about a horizontal axis between a generally vertical position and a generally horizontal position and a flush valve for flushing fluid from the cistern to the toilet bowl, said toilet-seat operating device comprising:

a control drum having a fluid inlet and a fluid outlet and a pressure plate disposed therebetween;

a spring in said control drum biasing said pressure plate toward said fluid inlet;

a fluid pipeline connecting a pressurized working fluid supply to said fluid inlet and a control valve in said fluid pipeline for controlling the supply and cutoff of working fluid to said fluid inlet of said control drum;

a connector connecting said pressure plate to the toilet seat such that lowering of said toilet seat moves said pressure plate towards said fluid outlet and compresses said spring, and movement of said pressure plate by the pressure of said spring toward said fluid inlet raises said toilet seat;

wherein opening of said control valve causes working fluid to be supplied to said control drum to move said pressure plate, lowering said toilet seat under its own weight and causing energy from the lowering of said toilet seat and the working fluid to be stored, and closing of said control valve causes working fluid to be cut off from said control drum and said spring to release the stored energy therein so that the toilet seat is tended to be raised.

8. The toilet-seat operating device of claim 7, wherein a gap is provided between said pressure plate and the interior of said control drum, enabling working fluid to flow around said pressure plate when said pressure plate is moved toward said fluid inlet by said spring.

9. The toilet-seat operating device of claim 7, wherein a second connector connects the flush valve to said pressure plate so that said pressure plate opens the flush valve to flush fluid from the cistern to the toilet bowl in response to said pressure plate being moved toward said first fluid inlet.

10. The toilet-seat operating device of claim 7, wherein said connector comprises a connecting lever unit engaged with the toilet seat and a link body having one end joined to said connecting level unit and the other end to said pressure plate.

* * * * *